United States Patent [19]

Ekman

[11] 4,207,126

[45] Jun. 10, 1980

[54] WATERGEL EXPLOSIVES CONTAINING MICROSPHERES

[75] Inventor: Gunnar O. Ekman, Nora, Sweden

[73] Assignee: Nitro Nobel AB, Gyttorp, Sweden

[21] Appl. No.: 963,208

[22] Filed: Nov. 24, 1978

[30] Foreign Application Priority Data

Dec. 15, 1977 [SE] Sweden ..... 7714240

[51] Int. Cl.[2] ..... C06B 23/00

[52] U.S. Cl. ..... 149/109.6; 149/2; 149/21; 264/3 C

[58] Field of Search ..... 149/109.6, 2, 21; 264/3 C

[56] References Cited

U.S. PATENT DOCUMENTS 3,773,573 11/1973 Slykhouse ..... 149/2 X

*Primary Examiner*—Stephen J. Lechert, Jr.

*Attorney, Agent, or Firm*—Hane, Roberts. Spiecens & Cohen

[57] ABSTRACT

A process for the manufacture of water gel explosives comprising mixing microspheres to be expanded in a concentrated solution or eutectic melt containing part of the ingredients of the finished explosive such that the microspheres can be expanded at a temperature at which there is no danger of explosion of the mixture. In particular, the solution or ment has an oxygen balance in which it poses no safety risk at the temperature required for the expansion of the microspheres. Thereafter, at a lower temperature the remaining components of the explosive including the sensitizer are mixed with this premix containing the expanded microspheres.

2 Claims, No Drawings

WATERGEL EXPLOSIVES CONTAINING MICROSPHERES

FIELD OF THE INVENTION

The present invention relates to a process, involving improved safety, for preparing watergel explosives, containing expanded thermoplastic microspheres as gas carriers, said explosives, in addition, demonstrating improved performance characteristics in important respects.

PRIOR ART

Watergel explosives generally contain one or more oxidizing salts, e.g. ammonium nitrate; one or more combustible materials, e.g. finely pulverized metals, wood meal, carbohydrates, urea; a gelling agent, e.g. guar; sensitizers, e.g. trinitrotoluene, powder, alkyl ammonium nitrate.

As has been known for a long time, the additional presence of small gas bubbles is indispensible for sensitizing watergel explosives.

Various ways of generating such bubbles are known. Thus, they can be produced by powerful mechanical processing of the explosive composition combined with suitable surface active agents. Another way is preparing the gas bubbles by chemical means. A third alternative is conducting air onto the surface of a dry powder, e.g. dry wood meal, aluminum powder etc. Finally, the gas bubbles can be replaced by hollow spheres of a suitable size and a suitable material.

The use of thermoplastic microspheres is described in U.S. Pat. No. 3,773,573. According to this patent, the microspheres may be expanded in advance or at a stage of the preparation of the explosive where the temperature is sufficiently high for performing the expansion.

Exemplary of such microspheres are SARAN® Microspheres from Dow Chemical Co., which are supplied with a moisture content of about 35 percent by weight in the shape of a so-called "wet cake", the consistency of which similar intensely whipped cream. The wall material of these spheres is SARAN (vinylidene chloride - acrylonitrile copolymer) having in their unexpanded state a diameter of 5–8 μm and containing isobutane. The expansion should take place at about 100° C., and the diameter of the spheres in expanded state amounts to 25–28 μm. If the cooling is reasonably rapid, this diameter is on the whole retained.

Using microspheres expanded in advance leads either to dust problems difficult to master, if the spheres have a too low moisture content, or else to the introduction of unacceptably large quantities of water into the explosive.

Expanding the spheres at such an advanced stage of the manufacturing process that oxygen-balanced compositions occur, may cause serious safety problems, since the expansion requires a temperature of about 100° C. Tests carried out demonstrate that oxygen-balanced salt solutions with expanded spheres are sensitive to detonators at this temperature.

SUMMARY OF THE INVENTION

According to the present invention, as a first step of the manufacturing process, the microspheres are expanded in a concentrated solution or eutectic melt composed of parts of the salts and possibly other constituents intended for the finished explosive, and having an oxygen balance and a composition that do not involve any risk from a safety point of view. Hence, at this step of the process only the smallest possible quantity of combustible material is allowed to be present. Of course, the solution or melt referred to has such a composition that it can be directly employed as an ingredient in the subsequent preparation of the finished explosive.

The quantity of microspheres present in the explosive has the function of controlling the explosive in so far as it provides a means by which the sensitivity and density of the explosive within certain limits can be fixed.

As is indicated in the examples below, in practising the present invention the explosive obtained demonstrates improved performance characteristics as far as velocity of detonation and functioning at static pressure are concerned, while the initiability at lower temperature is similar to that of a corresponding explosive whose "hot spots" have been generated by mechanical or chemical means.

DESCRIPTION OF PREFERRED EMBODIMENTS

The process is best illustrated by the following examples.

EXAMPLE 1

| | |
|---|---|
| 183 parts by weight ammonium nitrate /$NH_4NO_3$/<br>100 parts by weight Calcium Nitrate TQ (Norsk Hydro)* /$NH_4NO_3 \cdot 5\ Ca(NO_3)_2 \cdot 10\ H_2O$/<br>34 parts by weight urea /$(NH_2)_2CO$/<br>10 parts by weight water | Solution I |

*according to the attached data sheet

Formula:

$5\ Ca(NO_3)_2 \cdot NH_4NO_3 \cdot 10\ H_2O$

Description:

White deliquescent, smooth, sperical pellets (prills).

Easily soluble in water, alcohol, acetone.

Properties:

The product consists of calcium nitrate [$Ca(NO_3)_2$] with 5.7–6.5% ammonium nitrate ($NH_4NO_3$) and 15% water of crystallization.

Ca-content: min. 19%

N-content(total): min. 15.5%

Maximum limits of impurities (%):

Mn max. 0.02

Na max. 0.015

K max. 0.01

Mg max. 0.15

Cu max. 0.0001

Pb max. 0.00005

Fe max. 0.001

Al max. 0.0001

$SO_4^{2-}$ max. 0.04

$Cl^-$ max. 0.005

$HCOO^-$ max. 0.3

$SiO_2$ max. 0.005

Urea max. 0.1

Insolubles

In water, max. 0.02

Typical Bulk Density:

vibrated: 1.17 kg/dm$^3$ unvibrated: 1.08 kg/dm$^3$

Typical Screen Analysis:

>4 mm = 0.1%

4–2 mm = 10%

2–1 mm = 82%

1–0.5 mm = 7%

<0.5 mm = 0.2%

Uses:

In the production of pyrotechnics, explosives (including slurry explosives), other nitrates.

In sprays to reduce occurence of Bitter Pits and Baldwin Spots in apples.

In calcination of radioactive wastes.

As an additive to control the setting of concrete.

Calcium Nitrate TQ may be added to effluents in order to help micro-organisms in decomposing organic wastes.

Packing:

Multiwall paperbags of 50 kilos gross or 100 lbs net.

Produced at:

Eidanger Salpeterfabriker, Heroya, nr. Porsgrunn, Norway.

were mixed. The added quantity of urea (combustible material) was the smallest possible to constitute a solution of a mixture crystallizing at about 80° C.

The solution was heated to about 105° C., at which temperature 17 parts by weight of microspheres (SARAN® Microspheres from Dow Chemical Co.) moistened to a water content of 50 percent by weight were added. The microspheres were allowed to expand for 30 seconds, their volume then amounting to 25–30 times their original volume.

Then a solution was added having the composition

| | |
|---|---|
| 200 parts by weight ammonium nitrate /$NH_4NO_3$/<br>216 parts by weight methyl ammonium nitrate /$CH_3NH_3NO_3$/<br>54 parts by weight water | Solution II |

and a temperature of 40° C., the mixture then getting a temperature of about 70° C., which is acceptable from a safety point of view.

Finally a powdered mixture consisting of

| |
|---|
| 120 parts by weight sodium nitrate /$NaNO_3$/<br>55 parts by weight aluminum powder<br>11 parts by weight guar |

was added.

The explosive prepared in this way had the following composition

| | |
|---|---|
| 389.5 | parts by weight ammonium nitrate /$NH_4NO_3$/ |
| 79 | parts by weight calcium nitrate /$Ca(NO_3)_2$/ |
| 120 | parts by weight sodium nitrate /$NaNO_3$/ |
| 216 | parts by weight methyl ammonium nitrate /$CH_3NH$ |
| 34 | parts by weight urea /$(NH_2)_2CO$/ |
| 55 | parts by weight aluminum powder |
| 11 | parts by weight guar |
| 87 | parts by weight water |
| 8.5 | parts by weight microspheres (in terms of dry |
| 1000 | parts by weight explosive |

In a charge with a diameter of 32 mm, which was initiated by means of a detonator No. 8, the explosive thus prepared demonstrated a velocity of detonation of 4400 m/sec, whereas an analogous explosive, whose "hot spots" (gas bubbles) had been produced by mechanical treatment or by chemical generation of gas, exhibited a velocity of detonation of 4000 m/sec. Hence, the explosive manufactured according to the present invention demonstrated an increase of the velocity of detonation amounting to 10 percent.

The initiability of the explosive at lower temperature was similar to that of an explosive whose "hot spots" had been generated by mechanical or chemical means.

As far as the activity at static pressure is concerned, the explosive prepared as described above exhibited fully satisfactory initiability and stability of detonation at a static overpressure as high as 500–600 kPa, whereas to ensure perfect functioning in the above-named respects of an explosive whose "hot spots" have been generated by mechanical or chemical means, there is an upper limit of the static pressure at 100–200 kPa.

EXAMPLE 2

| |
|---|
| 83 parts by weight ammmonium nitrate /$NH_4NO_3$/ |

-continued

| |
|---|
| 100 parts by weight Calcium NItrate TQ<br>17 parts by weight SARAN® Microspheres with a dry |

were mixed, and the mixture was heated to 110° C. the spheres then expanding to 25–30 times their original volume. After crystallization of the solution the solid mass was ground.

The powder obtained was mixed with

| |
|---|
| 300 parts by weight ammonium nitrate /$NH_4NO_3$/<br>120 parts by weight sodium nitrate /$NaNO_3$/<br>55 parts by weight aluminum powder<br>11 parts by weight guar |

resulting in a premix, which did not contain any sensitizer and which, therefore, was suitable for storing pending further processing.

The premix as described above was later on stirred into a solution having the following composition

| |
|---|
| 216 parts by weight methyl ammonium nitrate /$CH_3NH_3NO_3$/<br>34 parts by weight urea /$(NH_2)_2CO$/<br>64 parts by weight water |

The explosive thus obtained had a composition similar to that of the explosive according to Example 1 and actually demonstrated similar performance characteristics.

EXAMPLE 3

A solution of the same composition as the Solution I of Example 1 was employed as a driving jet of liquid in an injector, and a suspension of 50 percent by weight of microspheres (SARAN® Microspheres) constituted the liquid propelled. The injector was connected to a type of static mixer supplied by Kenics Corporation, U.S.A. under the name of "Static Mixer". The outlet of said mixer led to a second mixer of a more conventional type, in which a solution of the same composition as the Solution II in Example 1 had been prepared.

A pulverous mixture having a composition similar to that of the mixture in Example 1 containing sodium nitrate, pulverous aluminum and guar, was admixed.

The finished explosive demonstrated performance characteristics similar to those of the explosive according to Example 1 and Example 2.

EXAMPLE 4

| |
|---|
| 385 g of Calcium Nitrate TQ<br>370 g of ammonium nitrate<br>15 g of SARAN® Microspheres with a dry content of 50 percent by weight |

where mixed and heated to 100° C., the components then forming a solution at the same time as the spheres expanded.

To this solution 110 g sugar, 110 g urea and 10 g guar were added.

The resultant explosive, which did not include any sensitizer, had a density of 1120 kg/m$^3$. It detonated completely in an iron tube having an internal diameter of 25 mm, by employing a primer containing 3 g hexogen.

The examples presented above are not intended to restrict the scope of the invention, for example as regards the composition of the explosive, the material from which the microspheres are prepared, physical and chemical conditions etc., but variations and modifications are within the limits established by the subsequent patent claims.

It is obvious that the process according to Example 3 can advantageously be applied as a continuous one.

I claim:

1. A process, satisfying rigorous demands for safety, for the manufacture of water gel explosives with improved performance characteristics, which explosives contain combustible materials, oxidizing agents, a gelling agent, water, sensitizers, and expanded thermoplastic microspheres as gas carriers, the improvement comprising carrying out the process in a succession of steps; including a first step of expanding the microspheres in a concentrated solution or eutectic melt consisting of part of the salts intended as components of the finished explosive, providing an oxygen balance in said solution or melt which does not make said solution or melt a safety risk at the temperature required for the expansion of the microspheres; and admixing at a lower temperature acceptable from a safety point of view the maintaining components of the explosive including the sensitizer.

2. A process according to claim 1, comprising cooling and crystallizing the mixture in which the microspheres have been expanded, adding additional salts and other ingredients intended to form part of the finished explosive, without the sensitizer, to form a prefix, and then adding the sensitizer to the premix.

* * * * *